United States Patent [19]

Schwartz

[11] 4,327,257

[45] Apr. 27, 1982

[54] ALIGNMENT DEVICE FOR ELECTRO-ACOUSTICAL TRANSDUCERS

[76] Inventor: Leslie H. Schwartz, 23726 Kittridge St., Canoga Park, Calif. 91307

[21] Appl. No.: 74,144

[22] Filed: Sep. 10, 1979

[51] Int. Cl.[3] ..... H04R 9/06

[52] U.S. Cl. ..... 179/115.5 R; 179/115.5 ES; 179/117; 181/171

[58] Field of Search ..... 179/115.5 ES, 115.5 R, 179/120, 117, 138; 181/171, 157

[56] References Cited

U.S. PATENT DOCUMENTS

| | | | |
|---|---|---|---|
| 2,069,242 | 2/1937 | Graham | 179/101 |
| 2,141,208 | 12/1938 | Eaves | 179/108 |
| 2,482,148 | 9/1949 | Beckman et al. | 179/115.5 R |
| 2,517,727 | 8/1950 | Smith | 179/115.5 R |
| 2,548,235 | 4/1951 | Olson | 179/1 |
| 2,655,566 | 10/1953 | Pittinger | 179/115.5 |
| 2,756,281 | 7/1956 | Pittinger | 179/115.5 |
| 3,925,626 | 12/1975 | Stallings, Jr. | 179/115.5 ES |
| 3,955,055 | 5/1976 | Kawakami et al. | 179/115.5 R |
| 4,013,846 | 3/1977 | Krawczak et al. | 179/115.5 R |

OTHER PUBLICATIONS

Rice, Kellogg, "Notes on the Development of a New Type of Hornless Loud Speaker".

Matsch, *Electromagnetic and Electromechanical Machines,* Intext Educational Publishers, Scranton, Pa., 1972.

"Micro Revue 8," Sennheiser.

Badmaieff, "The Use of Polyester Films in Microphone Design", *Journal of the Audio Engineering Society,* vol. 9, No. 3, Jul. 1961.

"Stark Designs", Brochure.

"Gauss by Cetec Audio", Brochure.

"JBL Loudspeaker Components", (Catalog CCS/76-JBL).

"515B Low-Frequency Loudspeaker", Altec Pub. AL-1853-2.

Polgreen, G. R., *New Applications of Modern Magnets,* pp. 63, 62, 90, 91, 184, 185 & 189, London, 1966.

Colloms, Martin, *High Performance Loudspeakers,* pp. 56-59, 118 & 119, New York, 1978.

Bozak, R. T., "Design of a 27-Inch Loudspeaker", Electronics, Jun. 1940.

Yamaha Brochure "NS-1000, NS 1000-M".

*Primary Examiner*—Glen R. Swann, III

*Attorney, Agent, or Firm*—John J. Posta, Jr.

[57] ABSTRACT

An electro-acoustical transducer has a voice coil assembly, a diaphragm coupled to the voice coil, a permanent magnet arrangement for providing a magnetic field in an air gap, and support means for axially centering the voice coil assembly in the air gap and means for maintaining axial alignment of the voice coil assembly during movement thereof. In one embodiment, the permanent magnet arrangement comprises two concentrically disposed permanent magnets whose adjacent faces are oppositely poled. In some embodiments, the support means comprises a rigid diaphragm disposed between rigid top and bottom spiders and at least one slideably mounted rod connecting the two spiders. Other embodiments of the invention use a single rigid spider which is guided on a single stationary centering rod.

9 Claims, 20 Drawing Figures

ALIGNMENT DEVICE FOR ELECTRO-ACOUSTICAL TRANSDUCERS

BACKGROUND OF THE INVENTION

The invention relates to systems and/or devices for conversion of electrical energy into acoustical energy, eg loudspeakers; and/or for the conversion of acoustical energy into electrical energy, eg microphones.

The basis for the design of many types of moving-coil-dynamic loudspeakers is set forth in a 1927 article entitled, "Notes on the Development of a New Type of Hornless Loudspeaker," by Chester W. Rice and Edward W. Kellogg, published in the AIEE Journal. As therein described, the primary determinents were the use of a field coil, which dictated the shape of the magnetic structure; and, since the best materials then available for diaphragm fabrication were paper and thin spun aluminum, it was necessary to form the diaphragm into a cone shape for structural rigidity. In the just cited article, it is recognized that the ideal diaphragm would be completely rigid and move as a unit (piston action) in response to the forces applied by the voice coil.

Within the Rice-Kellogg design, a larger voice coil diameter would necessitate an increase in the mass of the moving system and a resultant decrease in efficiency which was unacceptable due to the low power from audio amplifiers then extant. For example, the special "high power" amplifier developed by Rice and Kellogg produced only 70 milliampers at 200 volts; and this small output power required that the speaker voice coil diameter be small, eg 1.00" to 2.00", by comparison to the 3.00" to 4.125" voice coil diameter used in high power loudspeakers of current design. Loudspeaker acoustic output requirements have increased as high sound pressure levels are often required, for example, in applications involving large auditoriums and/or "rock-level" sound volumes; and there are now many amplifiers capable of generating power outputs in excess of 200 watts at 8 ohms.

Electromagnets as used in early loudspeakers utilized a metal core which strengthened the magnetic field generated by the field coil current by a factor of about 1,000 over the magnetic field strength generated with an air core. In these designs the voice coil windings were short, eg ¼", and the windings were enclosed by the static magnetic flux throughout the entire range of axial excursion, yielding a comparatively high efficiency. Because of the limited axial displacement, diaphragm size was maximized and/or horn loading was utilized.

When hard steel metal magnets replaced field coil designs (circa 1931 Jensen Manufacturing Company), magnets with large volumes between the working pole faces were required to produce acceptable efficiency. The magnetic return structure, a low reluctance soft iron material equivalent to the electro-magnetic metal core, was retained. With the subsequent introduction of more advanced materials such as Alinco 5 types, barium ferrite (ceramics), and rare earth cobalt micropowders, advances in stability and long term performance were made; eg, reduced sensitivity to magnetic loss due to heat and shock was achieved.

However, current art magnetic structures suffer from losses of the actual energy product B (flux density)×H (coercivity) of the magnet via:

1. leakage—which occurs at all joints between the pieces of the structure;

2. fringing—due to spurious magnetic circuits other than the working air gap; and 3. hot spots—uneven distribution of flux density within the return structure.

U.S. Pat Nos. 2,141,208, 2,548,235, and 2,756,281 illustrate various configurations of magnetic structures used in prior art loudspeakers.

Other loudspeaker developments include the use of advanced materials for the cone diaphragm; plastics; polystyrene, polypropylene, expanded polystyrene foam, metals; aluminum, beryllium, boron, and plastic-metal combinations, such as expanded polystyrene foam laminated with aluminum foil and honeycombed aluminum with a polystyrene laminate. In addition, formulations of paper reinforced with stiff carbon fibers have also been utilized in various designs to increase rigidity and reduce cone breakup which is an important contributor to distortion in loudspeakers. In other designs, various materials have improved (controlled the mechanical resistance-compliance of) the voice coil centering spider and cone surround which, as Rice and Kellogg recognized, were important design goals.

However, in todays most widely used speakers, the basic mechanical shape and parameters have not significantly changed from those described by Rice and Kellogg. The dynamic loudspeaker is most often found to be a cone (convex-funnel) shaped diaphragm driven at its apex by a moving voice coil situated in a permanent magnet field. However, U.S. Pat. Nos. 2,655,566 and 2,756,281 disclose configurations whereby a centrally disposed rod drives a conically shaped diaphragm from its apex, and the rod is driven by a voice coil assembly. U.S. Pat. No. 2,069,242 purports to be a vibratory system of true piston or plunger action, and employs a driven member which takes the form of a truncated cone of rigid construction which is driven by a flexing cylinder which may be flexed in an accordian fashion.

The acoustic output of a loudspeaker is a function of diaphragm size and diaphragm displacement (excursion capability); other variables include electromagnetic conversion efficiency, rigidity of the diaphragm, and the acoustic impedance and capacitance of the air to vibration at various frequencies. Previous attempts to produce greater levels of acoustic output and deeper bass reproduction have generally been limited to increasing the diaphragm diameter of the loudspeaker, because, leaving aside the current art magnetic design limitations discussed above, the surround and spider (suspension elements) of current design speakers typically limit useful cone excursion to an average upper limit of ±0.25 inch (one-half inch peak-to-peak). This excursion limit places a limit upon both the frequency (low frequency) which can be produced and the sound pressure level of the reproduction. For example, in order for an 8" diameter loudspeaker to produce one acoustic watt at thirty hertz (cycles) it must undergo a ±2.0" excursion. This acoustic output is clearly outside the capability of the present designs which, as stated above, have a usable excursion range of about ±0.25 inch. Other current art designs have voice coil windings which are longer than the magnetic return plates which define the linear area of the magnetic field and therefore have reduced efficiency.

In most types of current design speakers, the centering spider and surround mechanically inhibit cone vibration at some frequencies, and cause a run-on of vibration at other frequencies. Generally there is a characteristic run-on of vibration in the lower output range which is called the bass resonant frequency (BRF) of the loudspeaker. The BRF is affected by electromagnetic factors such as amplifier output dampening; the magnetic flux strength in the voice coil gap; the acoustic loading factors such as the type and size of the enclosure or the placement of the enclosure in the listening environment. The BRF is also affected by the mechanical aspects of the loudspeaker, such as the mass of the diaphragm, or the axial compliance of the suspension elements. Any of these factors can contribute to a frequency response, and output pressure level disproportionate to the relative level of the input signal. Hence, in loudspeakers of current designs, surround and spider contribute to amplitude distortion, and large low frequency excursions are compressed by the suspension limits. Also the suspension elements contribute to amplitude distortion due to their frequency dependent mechanical resistance to axial travel.

As Rice and Kellogg described it, the ideal design would be inertia controlled by the mass of the moving elements and would be operated above the lower natural resonant frequency; rather than resistance controlled where the major resonant frequencies occur within the intended range of reproduction. Rice and Kellogg showed that a completely rigid inertia controlled diaphragm, when driven by a constant amplitude electrical signal, would have a linear acoustic output over its working range.

There is no completely rigid material or design shape, and in the current design speakers, depending upon the thickness, density, configuration and materials used, the diaphragm does not act as a rigid piston. Vibrations originating in the motor elements are driven through the diaphragm from apex to surround at various rates, and depending upon the diaphragm design, various frequencies are absorbed or reinforced due to antiphase movements of the diaphragm itself. Because the non-rigid diaphragm acts as a transmission line for vibration, and because the speed of sound in the surrounding air and the cone material often differ, significant amplitude and frequency modulation distortion occurs.

Regarding diaphragm and voice coil former movement, ideally there is high axial flexibility and no flexibility at any angle which would allow the voice coil former to strike or rub against the magnetic assembly. As a result, in current design high output speakers, a comparatively large magnetic gap is needed, as high excursions often result in skewed motor movement and a distortion of the circular shape of the voice coil former at the apex of the diaphragm. However, a large magnetic gap reduces the magnetic flux density in the gap which may exaggerate the bass resonant frequency peak, increases the response time to input signals (lower transient response), and increases the working temperature of the voice coil wire—which increases the resistance of the wire, lowers the electromagnetic efficiency, and contributes to voice coil burnout.

SUMMARY OF THE INVENTION

A primary object of the subject invention is to provide new and improved electro-acoustical transducers.

Another object is to provide a loudspeaker capable of longer axial excursions so as to generate relatively higher levels of audible bass frequency tones and a higher acoustic level of combined frequency tones.

A more particular object is to provide loudspeakers capable of greater excursions (eg greater than ±1 inch), of a more rigid diaphragm in order to produce "deeper" bass frequencies, higher acoustic outputs over a range of low and middle frequencies, and less amplitude and intermodulation distortion.

A further object is to provide electro-acoustical transducers which have magnetic structures that provide performance and efficiency improvements.

A further object is to provide a loudspeaker system capable of longer excursions before significant nonlinearity is met in the axial restoring system (suspension elements), of generating lower levels of amplitude distortion at higher levels of acoustic output and of generating lower levels of amplitude distortion when radiating bass frequencies.

An additional object is to provide an improved loudspeaker of a rigid diaphragm design which reduces intermodulation and amplitude distortion due to antiphase diaphragm movement (cone breakup).

The subject invention relates to electro-acoustical energy transducers such as loudspeakers, headphones, and microphones of the type which have a voice coil assembly, a diaphragm coupled to the voice coil, a permanent magnet arrangement for providing a magnetic field in an air gap, and support means for axially centering the voice coil assembly in the air gap and for allowing the axial movement of the voice coil assembly and the diaphragm. In the case of loudspeakers and headphones, the axial movement of the voice coil assembly is in response to the magnetic interaction between the magnetic field produced by the voice coil and the permanent magnet arrangement. In accordance with one embodiment of the subject invention, the permanent magnet arrangement comprises two concentrically disposed cylindrically shaped permanent magnets for providing a high intensity magnetic field in the air gap. In order to minimize losses in magnetic efficiency, the subject invention implements a novel approach to the magnetic structure. By a 90° reorientation of the current art field pole alignment, and by placing the poles of the magnetic material across the working air gap, magnetic leakage is substantially eliminated, as no pole pieces or joints of a structure occur in the magnetic path, ie in the preferred embodiment there is no magnetic return structure, since all magnet support members are of non-magnetic material. The magnetic alignment is such that the adjacent magnet faces are oppositely poled, eg a north (N) poled face opposite from a south (S) poled face. Air gap flux density in accordance with the invention corresponds to the typical residual induction value of the material used, facilitating the efficiency, important in energy conversion transducers (eg microphones, loudspeakers). In addition to affecting the above magnetic efficiencies, the novel geometry of the subject invention facilitates the design of moving coil transducers of extended axial travel.

For example, in one loudspeaker embodiment of the subject invention, a long voice coil winding moving within linear flux distribution over ±1" (or greater as designed) axial travel will allow higher acoustic levels of base frequency to be produced with less distortion for a given diaphragm diameter. Also greater voice coil diameters will be possible, giving good efficiency ($F=BL$) and good transient response; where "F" is the force acting on diaphragm, "B" is the flux density, and "L" is the length of wire in gap. Further, superior dissipation of heat generated by the voice coil minimizes voice coil burnout, and losses in efficiency due to increased conductor resistance with rising working temperatures.

In accordance with a further/another aspect of the invention, the support means includes a rigid top spider assembly affixed to the top of a rigid diaphragm, a rigid bottom spider assembly affixed to the bottom of said diaphragm, at least one rod connecting the two spider assemblies; a chassis for supporting the magnets and for carrying at least one alignment bearing through which the rod is slideably mounted, and means for returning, in the absence of other forces, the voice coil to a quiescent axial position in the air gap.

In one embodiment of the subject invention, the means for returning the voice coil includes at least one spring operatively disposed between the spider-diaphragm assembly and the chassis, and means for adjusting the spring tension.

In one embodiment of the invention, the support means comprises four alignment rods, each of which are slideably mounted through respective alignment bearings which are symetrically disposed within the radius of the inner permanent magnet. In accordance with another embodiment, four alignment rods are symetrically disposed outside of the outer magnet.

In accordance with an additional embodiment of the invention, centering of the voice coil assembly is implemented by top and bottom rigid spiders and a single support rod which is centrally disposed within the inner radius of the permanent magnets.

Advantages of the above summarized embodiments of the subject invention include:

Increased bass reproduction capability over current design speakers of the same nominal diameter—by allowing for greater axial excursions;

Increased acoustic output (sound pressure level volume) capability over current design speakers of the same nominal diameter—by allowing for greater axial excursions;

Decreased percentage of amplitude distortion generated within an expanded sound pressure level range and expanded bass frequency range—by allowing for longer diaphragm excursions before significantly non-linear restoring forces are encountered in the suspension system and nonlinear flux in the magnetic system; and Decreased intermodulation distortion at higher levels of acoustic output and deeper bass frequencies—by designing a moving system which is rigid at high axial excursions, the rigidity of which is not dependent upon axial excursion.

The rigidity is provided in certain embodiments by rigid spiders located above and below the voice coil former, which act to suppress vibrations and provide additional structural support to the diaphragm. Superior heat dissipation is provided as the voice coil former is typically two to three times longer axially than comparable current conically shaped voice coil formers, and the former acts as a conductor of heat away from the voice coil wire. Also, in accordance with the subject invention, the ring magnetic structure is deeper and more massive in the areas adjacent to the direction of axial travel of the voice coil; and the magnets act as a conductor of heat away from the voice coil. In addition, the subject invention allows for significantly larger diameter voice coils which contact a correspondingly greater volume of air circulating in the magnetic gap. The increased wire inductance which occurs with larger voice coil diameters may be compensated for by winding several layers of the coil in parallel (current art practice);

A speaker, in accordance with the subject invention, of a given moving structure mass will be more efficient than current design speakers of the same moving structure mass. For example, in high power designs, the invention allows for a smaller magnetic gap which provides a greater magnetic flux density within the gap, and flux strength may be optimized to increase electromechanical dampening, optimize the bass resonant frequency response, improve transient response, and increase the useful transfer of heat from the voice coil wire to the magnetic elements and chassis elements. Also speakers in accordance with the subject invention may have greater voice coil diameter and depth, and this allows for greater lengths of wire present in the gap to act upon the permanent magnetic field.

Speakers in accordance with the subject invention exhibit an increased accuracy of reproduction (transient response) for a given moving mass due to the greater magnetic and electrical efficiencies produced by the invention.

Another aspect of the subject invention allows for increased utility of a given transducer by means of a (optional) variable bass resonance frequency control which permits the same loudspeaker to be tuned to optimum performance to enclosures of various size and shape dependent upon the application. For example, in the home-domestic environment, typical enclosures include small to medium sized (1) bass reflex/Helmholtz resonator/phase inverter types, and (2) infinite baffle/-totally enclosed box. Loudspeaker enclosures typically found in auditoriums, arenas and large spaces include larger horn and combination horn/bass reflex types. The variable bass resonance control of the subject invention can be used to tune the loudspeaker to fit the many different types of enclosures according to well established formulas which have been shown to reduce unwanted peaks or depressions in the frequency response of the mounted loudspeaker—the peaks and depressions detract from the fidelity of reproduction (amplitude distortion).

Another embodiment of the invention comprises a midrange speaker with a conventional dome diaphragm and suspension, but with an improved magnetic structure in accordance with the invention.

Other embodiments of the invention use a single rigid spider which is guided on a single stationary centering pin or rod in combination with prior art magnetic structures or in combination with improved magnetic structures of the subject invention. Another embodiment utilizes a magnetic structure in accordance with the invention and a current art spider assembly.

Further embodiments incorporate improved magnetic designs in accordance with the subject invention into headphones and microphones having conventional coil/diaphragm suspension arrangements.

BRIEF DESCRIPTION OF THE DRAWINGS

The novel features of this invention, as well as the invention itself, will be better understood from the accompanying description taken in conjunction with the accompanying drawings in which like reference characters refer to like parts, and in which.

DETAILED DESCRIPTION OF THE PREFERRED EMBODIMENTS

Figure 1:
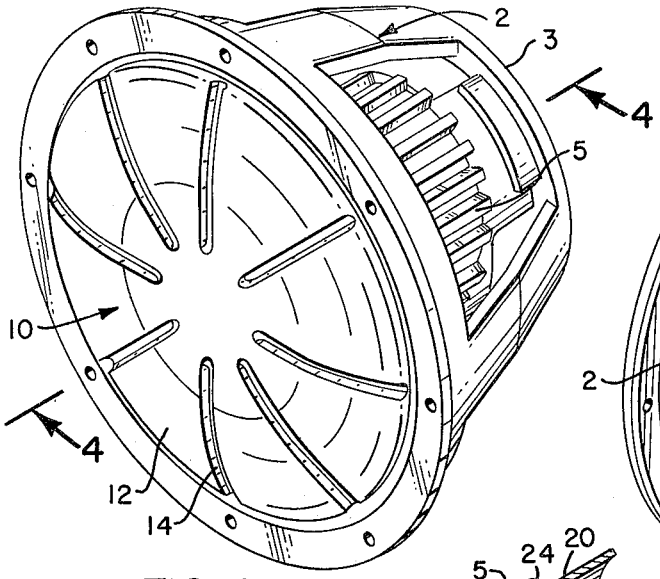
FIG. 1 is a perspective front view of a loudspeaker in accordance with the subject invention.
Figure 2:
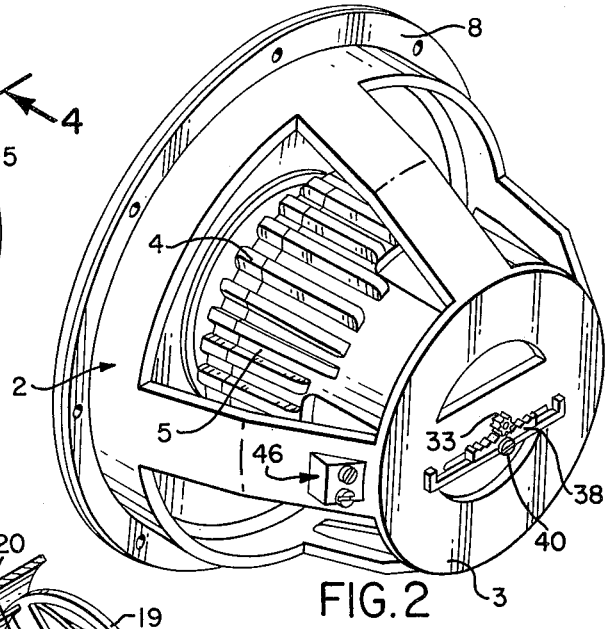
FIG. 2 is a perspective rear view of the loudspeaker of FIG. 1.
Figure 3:
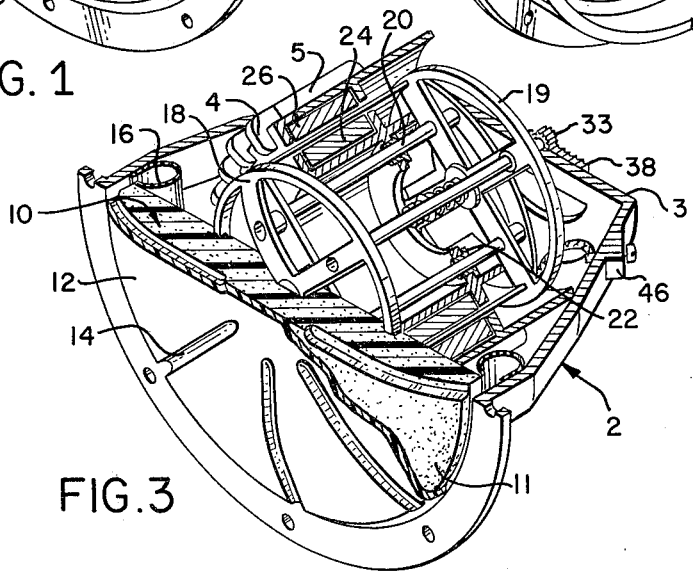
FIG. 3 is a partially cut away side elevation view of the speaker of FIGS. 1 and 2.
Figure 4:
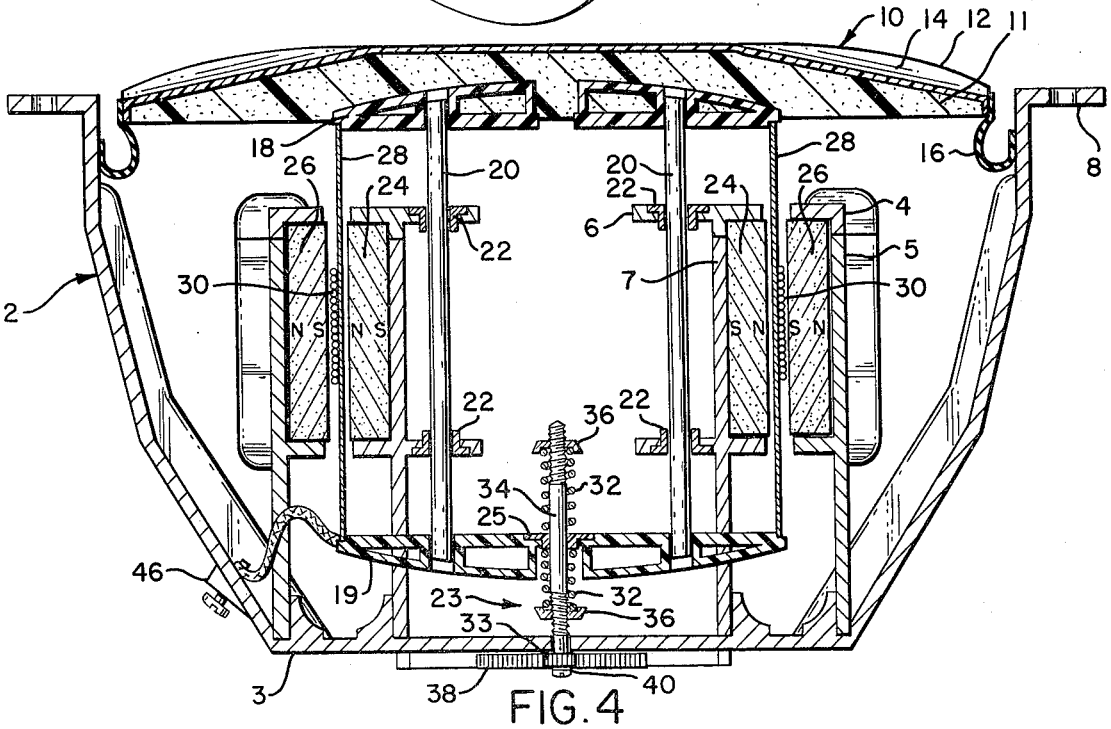
FIG. 4 is a sectional view taken along line 4—4 of FIG. 1.
Figures 5, 6, 7:
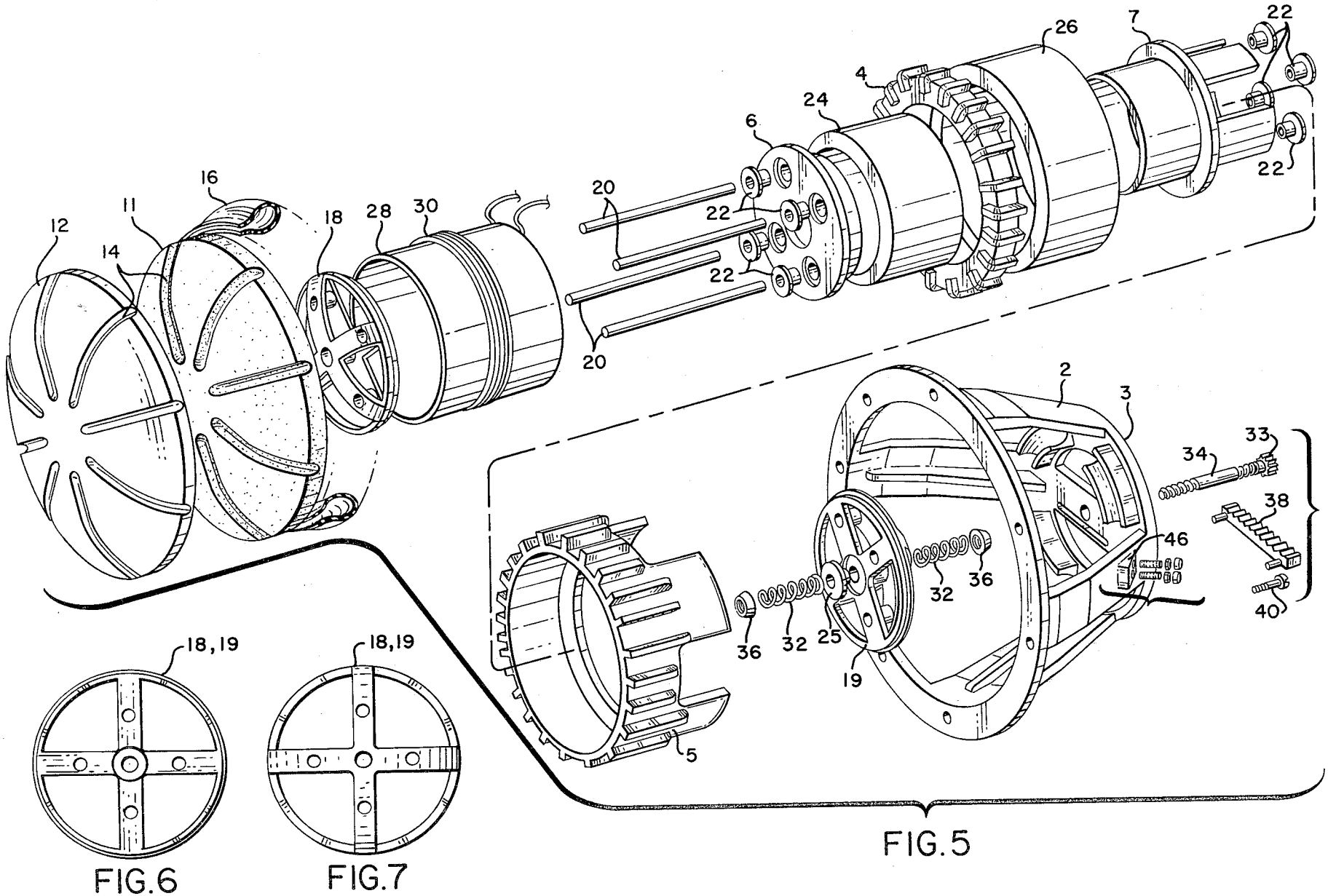
FIG. 5 is an exploded view of the loudspeaker of FIGS. 1 through 4.
FIGS. 6 and 7 are top and bottom views respectively of a rigid spider suitable for use in the loudspeaker of FIGS. 1 through 5.

Referring first primarily to FIGS. 1 through 7, in the loudspeaker embodiment there shown, a chassis 2 has a base plate 3, external ring magnet support members 4 and 5, and internal ring magnet support members 6 and 7 (shown best in FIG. 5). External ring magnets support members 4 and 5 have fins formed thereon so as to provide increased heat dissipation. A rear enclosure (not shown) may be readily mated to the loudspeaker in the area designated by reference numeral 8 (FIG. 2).

A voice coil former 28 (shown best in FIGS. 4 and 5) is supported between a top spider 18 and a bottom spider 19, and is aligned radially by means of alignement pins or rods 20. Cutout portions (not shown) of the voice coil former 28 may be used to optimize the heat dissipation thereof.

The upper spider 18 carries a diaphragm 10 that has an outer layer 12 which is the element that actually operates upon the air so as to create sound reproduction. Rigid detents or ribs 14 serve to increase the rigidity of the outer diaphragm layer 12.

Two permanent magnets are used in the magnetic structure, an inner magnet 24 and an outer magnet 26 with the voice coil former 28 being disposed therebetween. The magnets 24 and 26 are charged (magnetically oriented) diametrically in order to form the static magnetic field necessary. The depth of the two ring magnets 24 and 26 is such that a uniform effective magnetic flux operates upon the voice coil windings 30 throughout the intended excursion range of the voice coil former 28, except where, by design, the voice coil windings 30 extend above or below the ring magnets 24 and 26 at the limits of the voice coil axial excursion. In practice, a bass or high output reproducer (loudspeaker) will require a deeper magnetic structure than do mid-range and lower volume level reproducers.

As shown in FIG. 4, dust shroud (surround) 16 extends around the top outer edge of the diaphragm 10, which comprises inner layer 11 and outer layer 12, and one end of the shroud is cemented to outer layer 12. The shroud is of light weight material and is designed to have minimal influence upon the moving systems axial (mechanical) compliance. The function of the shroud is to keep dust and magnetic particles from interfering with the operation and movement of the "motor element" (diaphragm 10).

Still referring to FIGS. 1 through 7, the diametrical centering of the diaphragm 10, and hence the voice coil former 28, is accomplished by low friction alignment bushings 22 disposed in internal ring magnet support members 6 and 7 (see FIG. 5). The rods or pins 20 are slideably mounted within the bushings 22, and the bushings, rods and magnets are so disposed as to center voice coil former 28 in the center of the radial gap between inner magnet 24 and outer magnet 26, i.e. the voice coil wire 30 is prevented from contacting either of the magnets while full axial travel of the voice coil former 28 is allowed.

The voice coil former 28 is returned to its steady state position by means of a variable bass resonance control which is indicated generally by reference numeral 23 (see FIGS. 4 and 5). A threaded bolt 34 enters through the chassis base plate 3 and extends through the rigid lower spider 19. The head of the bolt 34 is a pinion gear 33 (see FIGS. 2 and 5) which contacts a sliding flat gear 38. When the moving elements, including voice coil former 28, are centered in the axial dimension (at rest due to the absence of an input signal) the length of the bolt above and below the lower spider 19 is substantially equal. The threads above the spider are reversed of the threads below the spider and there are no threads in the portion of the bolt 34 which is adjacent to chassis base plate 3, or the portion adjacent to the lower spider 19. A teflon thrust bearing 25 allows the moving system, including voice coil former 28, axial movement without friction over the length of the bolt. Threaded spring caps 36 hold springs 32 on ends thereof opposite spider 19. The spring ends are cemented to the spider and spring caps.

Movement of the flat gear 38 turns the bolt 34 which causes the spring caps to move towards or away from lower spider 19 in unison, an equal dimension. The inner end of the upper spring 32 is cemented to the bottom spider 19, and the inner end of the bottom spring 32 is cemented to the thrust bearing 25, which thrust bearing is cemented to spider 19; and caps 36 are cemented to the outer ends of springs 32. Hence the springs do not turn as bolt 34 is rotated and the effect is to compress or allow the expansion of the axial centering springs 32. As the springs are compressed, spring tension increases and the axial compliance of the moving system decreases; as the compliance decreases the natural bass resonant frequency rises to a higher frequency. The bass resonant frequency may be lowered by sliding the flat gear 38 in the opposite direction. A locking screw 40 (FIGS. 2 and 5) sets the flat gear 38 in place once the loudspeaker is tuned to its application. The axial center of the moving element is unchanged as the spring tension increases or decreases; however, with increased spring tension there is a slight decrease of the extent of the axial travel. Hence, the springs 32 are operatively disposed between the chassis 2 and the spider voice-coil assembly which comprises spiders 18, 19, voice-coil assembly 28 and rods 20.

Examples of materials that may be used in fabrications of various elements of the loudspeaker of FIGS. 1 through 7 are listed herein; however, it will be readily apparent to those skilled in the art that numerous other materials may be used for the various elements. Chassis elements 2 and 3 may be of die cast aluminum or steel, and preferrably elements 4, 5, 6, and 7 will be of a non-magnetic material such as die cast aluminum, for example. Diaphragm inner layer 11 may be formed of expanded polystyrene foam high density; or cross linked polyethylene foam. The diaphragm outerlayer 12 may be a rigid plastic layer, such as polypropoline or polystyrene about 0.01 inches thick, cemented to inner layer 11. The dust shroud or surround 16 may be unplasticized polyvinyl chloride or neophrene rubber thermoformed to shape. Top and bottom spiders 18 and 19 (see FIGS. 6 and 7), which may be identical, can be formed from rigid high temperature, high tolerance machinable material such as polysulfone or phenolic plastic. Alignment pins or rods 20 are low mass, hollow, straw-shaped, high tensile strength metal (e.g. aluminum or beryllium) with a teflon or plastic outer layer to reduce friction with the teflon thrust bearings 22. The alignment bearings 22 and 25 may be teflon thrust bearings such as NMB Corp. part AJF04 MS21241 Series (AJF-A or AJF-C), and may have an aluminum or chrome steel body with teflon interlining, or linear-thrust ball bearings such as the BARDON Corp. LP-4-MM or LS-4-MM. The magnets 24 and 26 can be, for example, Alinco 5 types, barium ferrite (ceramic) or rare earth cobalt micropowers; and the voice coil former 28 can be high temperature paper-plastic laminate or high temperature aluminum or beryllium. The voice coil wire may be high temperature copper, copper alloy, aluminum, aluminum alloy or silver clad aluminum, and it may be round wire or ribbon wire wound on end around the former 28. Springs 32 may be formed from metal alloy, spring caps 35 and bolt 34 from plastic polystyrene, and flat gear 38 from plastic nylon. Except where othewise noted, the various parts are joined by use of a suitable cement or epoxy.

In the operation of the embodiment of FIGS. 1–7, alternating current applied through connector terminal 46 (FIGS. 2 and 4) passes through the voice coil wire 30 and produces a changing magnetic field. This changing magnetic field interacts with the static permanent magnetic field produced by magnets 24 and 26 (which are polarized as shown in FIG. 4), so as to cause the motor elemets (connected to voice coil former 28) to move in or out about the axial dimension. The diaphragm 10 moves with the voice coil former 28 and in turn compresses and rarifies surrounding air so as to reproduce sound. The voice coil former is held in the center of the gap between magnets 24 and 26 by means of the alignment rods or pins 20.

Figure 8:
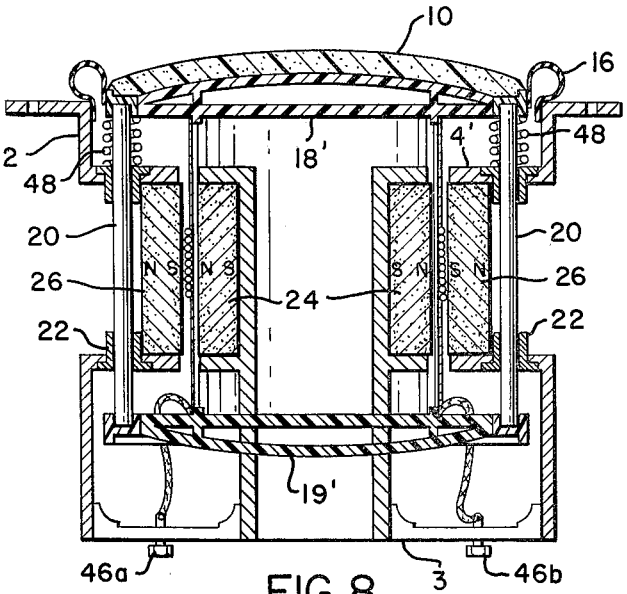
FIG. 8 is a sectional view of a second embodiment of the invention wherein the support rods for centering the voice coil assembly are disposed outside of the radial dimension of the permanent magnets.
Figure 9:
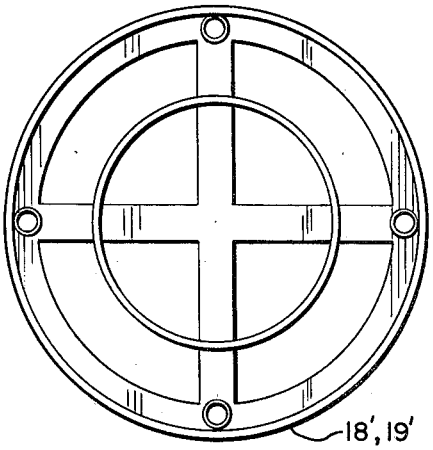
FIG. 9 is a bottom view of a top spider suitable for use in the loudspeaker of FIG. 8.

The embodiment shown in FIG. 8 is similar to that described hereinabove relative to FIGS. 1–7 except that the four alignment pins or rods 20 (only two shown) are disposed outside of the magnetic structure (24, 26) and four compliance springs 48 (only two shown) are disposed on respective rods between the upper spider 18' and external ring magnet support member 4'. Also in FIG. 8, the two electrical terminals are designated **46*a* and 46*b*. Top spider 18' and bottom spider 19' are identical, and the bottom view of spider 18' is shown in FIG. 9**.

Figure 10:
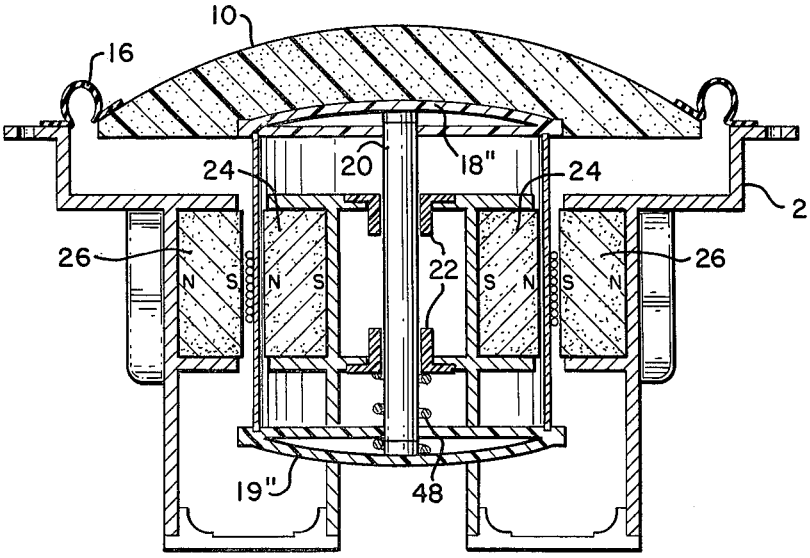
FIG. 10 is a sectional view of another embodiment of the invention wherein centering of the voice coil assembly is implemented by a single support rod which is centrally disposed within the inner radius of the permanent magnets.
Figure 14:
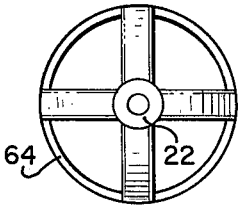
FIG. 14 is a top view of a rigid spider suitable for use in the embodiments of FIGS. 13, 15, 16 and 17.

In the embodiment shown in FIG. 10, the voice coil former is held in the center of the gap between magnets 24 and 26 by means of a single alignment rod 20 which is centrally disposed within inner magnet 24. Rod 20 is slideably mounted by means of teflon thrust bearings 22. The voice coil former is returned to its steady state position by compliance spring 48. Top and bottom spiders 18'' and 19'', which are identical, are similar in design to the spider shown in FIG. 14, except they have a recess adapted to receive rod 20 instead of the center opening shown in FIG. 14.

Figure 11:
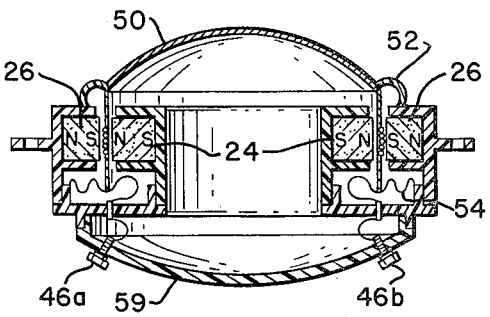
FIG. 11 is a sectional view of an additional embodiment of the invention which comprises a mid-range speaker with a conventional dome diaphragm and suspension, but with a magnetic structure in accordance with the invention.
Figure 12:
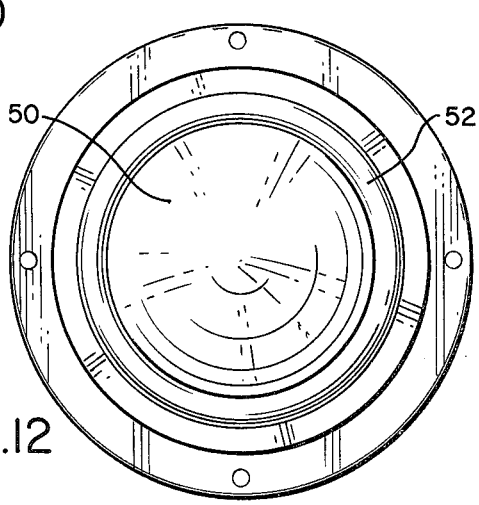
FIG. 12 is a top view of the embodiment of FIG. 11.

FIGS. 11 and 12 depict a mid-range embodiment of the subject invention which comprises a conventional dome diaphragm 50 which has a conventional front surround 52, a conventional spider 54 for rear suspension, and a two ring (24, 26) magnetic structure in accordance with the subject invention. Input connections are provided by terminals **46*a* and 46*b* which are mounted on rear housing 59**.

Figure 13:
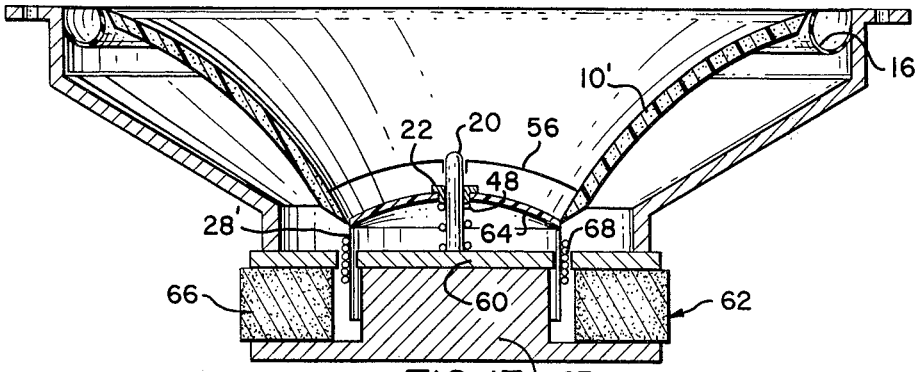
FIG. 13 is a sectional view of an embodiment which comprises a current art design of a low profile ceramic magnetic structure, but with a rigid spider and alignment means in accordance with the invention.

In the embodiment of FIG. 13, the alignment rod 20 is stationarily mounted on the central section 60 of a conventional magnetic structure 62, and the diaphragm-voice coil (10', 28') assembly is held in radial alignment thereby, i.e. the dome cover 56 of the cone shaped diaphragm 10' rides axially on the rod 20 by means of the thrust bearing 22, and the top spider 64 (FIG. 14) which is cemented to the diaphragm 10' and voice coil former 28' at their intersection. A relatively long voice coil winding is employed so as to reduce distortion products. The magnetic structure 62 comprises a single ceramic (barium ferrite) magnet 66 and a soft iron flux path 67 which creates a flux density across the gap 68. The embodiment of FIG. 13 avoids the problem associated with current art type spiders and allows for greater axial displacement and also improved centering of the voice coil over the greater axial displacement. With the current art type of magnetic structures, the just listed advantages are particularly important, inasmuch as they allow the use of smaller magnetic gaps which yield higher flux densities.

Figure 15:
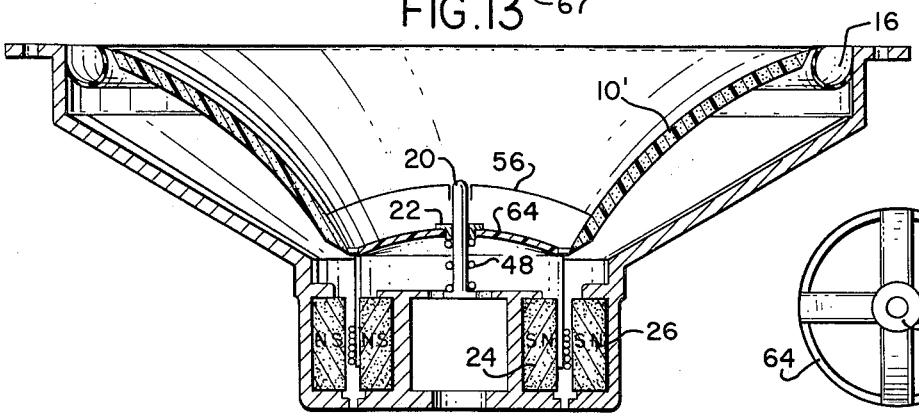
FIG. 15 is a sectional view of an embodiment which comprises a magnetic structure and rigid spider and alignment means in accordance with the invention, but which has a truncated conical shaped diaphragm.
Figure 17:
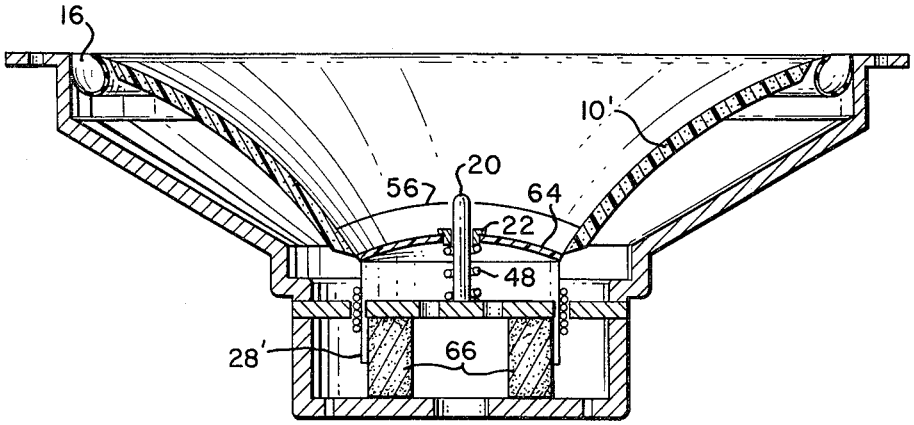
FIG. 17 is a sectional view of an embodiment which comprises a current art Alinco magnetic structure, but a rigid spider and alignment means in accordance with the invention.

The embodiment of FIG. 15 illustrates an embodiment comprising a two ring magnet structure (24, 26) in accordance with the invention as well as the stationary alignment pin diaphragm voice coil arrangement shown in FIGS. 13 and 17. A relatively long voice coil winding is also employed in the embodiment of FIG. 15 for the purpose of increased efficiency, as well as the reduction of distortion.

Figure 16:
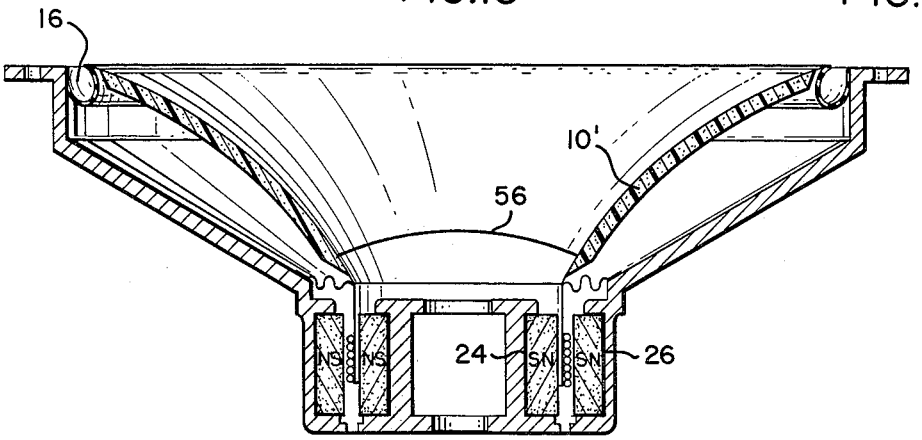
FIG. 16 is a sectional view of an embodiment which comprises a magnetic structure in accordance with the invention but a current art spider assembly.

The embodiment of FIG. 16 includes a prior art diaphragm support arrangement, a voice coil winding of extended length; and a two ring magnet structure (24, 26) in accordance with the invention.

The embodiment of FIG. 17 is similar to that of FIG. 13, except the prior art magnetic structure there shown has the single magnet 66 internal of the voice coil former 28'.

Figure 18:
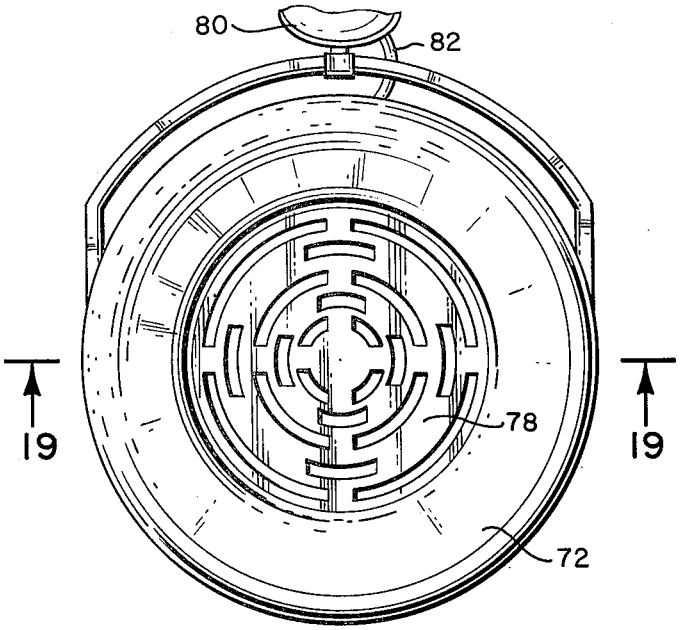
FIG. 18 is a front plan view of one portion of a headphone which incorporates the improved magnetic structure of the subject invention.
Figure 19:
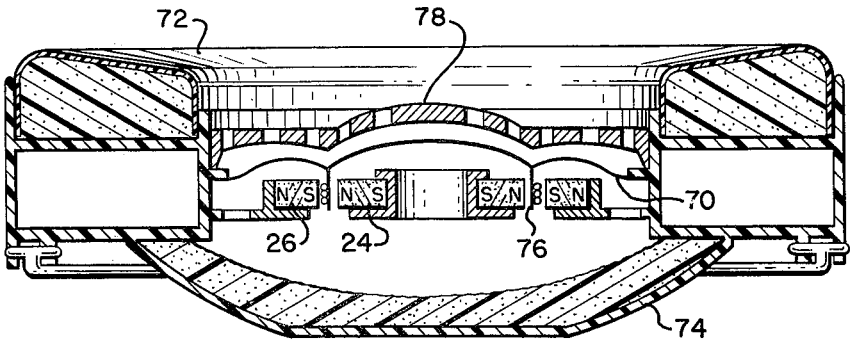
FIG. 19 is a sectional view of the headphone of FIG. 18.

FIGS. 18 and 19 depict one portion of a headphone which is conventional except for incorporation of the improved magnetic structure of the subject invention. As there shown, the diaphragm and integral surround assembly 70 is disposed between ear cushions 72 which are connected by rear enclosure 74. The voice coil former 76 operates in a gap between ring magnets 24, 26, and a phase correction plate 78 is disposed above diaphragm-surround assembly 70. A portion of headband 80 as well as input leads 82 are shown in the upper portion of FIG. 18.

Figure 20:
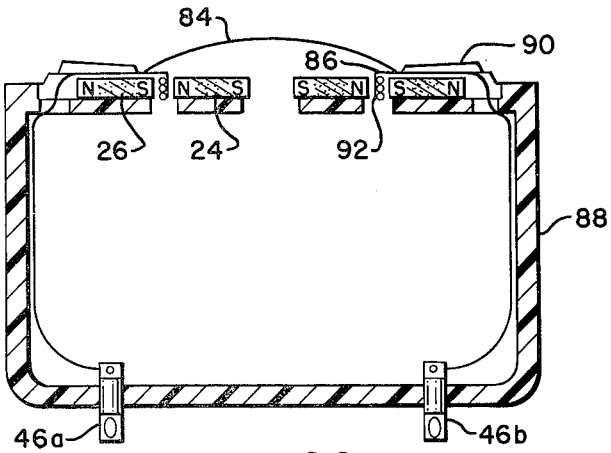
FIG. 20 is a sectional view of a microphone which incorporates the improved magnetic structure of the subject invention.

The microphone shown in FIG. 20 has a diaphragm 84 which carries a coil former 86 which is supported on case 88 by a conventional integral compliant suspension 90; and, except for the improved magnetic structure of the invention, the microphone of FIG. 20 is of conventional design. In accordance with the invention, the magnetic field in the gap 92 is supplied by means of two ring magnets 24 and 26, and output currents are supplied through terminals 46*a* and 46*b*.

Thus, having described new and useful electro-acoustical transducers which include loudspeakers, headphones, and microphones, what is claimed is:

1. A speaker for transforming applied electrical currents into acoustical energy comprising a voice coil assembly having a coil adapted for conducting said applied electrical currents, a diaphragm coupled to said voice coil assembly, magnetic means for providing a magnetic field in an air gap, support means for centering said voice coil assembly in said air gap and for allowing for the axial movement of said voice coil assembly and said diaphragm in response to the magnetic interaction between the magnetic fields produced by said voice coil and said magnetic means, wherein the improvement comprises:

said support means including a rigid top spider assembly disposed between the top of said voice coil assembly, which is rigid, and said diaphragm, a rigid bottom spider assembly affixed to the bottom of said voice coil assembly, at least one rod connecting said top and bottom spider assemblies, and a chassis for supporting said magnetic means and for carrying at least one alignment bushing through which said at least one rod is slideably mounted, and means for returning said voice coil assembly to a predetermined position along the length of said air gap in the absence of applied electrical currents, wherein said means for returning said voice coil assembly includes at least one spring operatively disposed between said spider-voice coil assembly and said chassis, and including means for adjusting the tension of said at least one spring.

2. A speaker for transforming applied electrical currents into acoustical energy comprising a voice coil assembly having a coil adapted for conducting said applied electrical currents, a diaphragm coupled to said voice coil assembly, magnetic means for providing a magnetic field in an air gap, support means for centering said voice coil assembly in said air gap and for allowing for the axial movement of said voice coil assembly and said diaphragm in response to the magnetic interaction between the magnetic fields produced by said voice coil and said magnetic means, wherein the improvement comprises:

said support means including a rigid top spider assembly diposed between the top of said voice coil assembly, which is rigid, and said diaphragm, a rigid bottom spider assembly affixed to the bottom of said voice coil assembly, at least one rod connecting said top and bottom spider assemblies, and a chassis for supporting said magnetic means and for carrying at least one alignment bushing through which said at leat one rod is slideably mounted, and means for returning said voice coil assembly to a predetermined position along the length of said air gap in the absence of applied electrical currents, wherein said means for returning said voice coil assembly includes a bolt threaded along portions of its length and rotatably mounted through openings in said chassis and one of said spiders, and at least one spring and a threaded spring cap disposed on said bolt on one side of said spider, one end of said spring being rigidly affixed to said spring cap and the other being rigidly affixed to said spider, whereby the rotation of said bolt changes the degree of compression of said spring.

3. The speaker of claim 2 wherein said means for returning said voice coil assembly further comprises a second spring and second threaded spring cap disposed on said bolt on the other side of said spider, one end of said second spring being rigidly affixed to said second spring cap and the other end of said second spring being rigidly affixed to said spider, whereby the rotation of said bolt also changes the compression of said second spring, and wherein said end caps are similarly threaded and the threads on the bolt in engagement with one end cap are reversed of the threads in engagement with the other end cap.

4. The speaker of claim 2 or 3 wherein the head of said bolt is a pinion gear and further comprising a flat gear slideably mounted on said chassis so as to operatively engage said pinion gear such that the sliding of said flat gear causes rotation of said pinion gear.

5. A speaker for transforming applied electrical currents into acoustical energy comprising a voice coil assembly having a coil adapted for conducting said applied electrical currents, a diaphragm coupling to said voice coil assembly, magnetic means for providing a magnetic field in an air gap, support means for centering said voice coil assembly in said air gap and for allowing for the axial movement of said voice coil assembly and said diaphragm in response to the magnetic interaction between the magnetic fields produced by said voice coil and said magnetic means, wherein the improvement comprises:

said support means including a rigid top spider assembly disposed between the top of said voice coil assembly, which is rigid, and said diaphragm, a rigid bottom spider assembly affixed to the bottom of said voice coil assembly, at least one rod connecting said top and bottom spider assemblies, and a chassis for supporting said magnetic means and for carrying at least one alignment bushing through which said at least one rod is slideably mounted, and means for returning said voice coil assembly to a predetermined position along the length of said air gap in the absence of applied electrical currents, wherein said magnetic means comprises two concentrically disposed cylindrically shaped permanent magnets whose adjacent faces are oppositely poled, and said support means comprises a plurality of rods each of which are slideably mounted through respective alignment bushings which are symetrically disposed within the circumference of the inner one of said permanent magnets.

6. A speaker for transforming applied electrical currents into acoustical energy comprising a voice coil assembly having a coil adapted for conducting said applied electrical currents, a diaphragm coupled to said voice coil assembly, magnetic means for providing a magnetic field in an air gap, support means for centering said voice coil assembly in said air gap and for allowing for the axial movement of said voice coil assembly and said diaphragm in response to the magnetic interaction between the magnetic fields produced by said voice coil and said magnetic means, wherein the improvement comprises:

said support means including a rigid top spider assembly disposed between the top of said voice coil assembly, which is rigid, and said diaphragm, a rigid bottom spider assembly affixed to the bottom of said voice coil assembly, at least one rod connecting said top and bottom spider assemblies, and a chassis for supporting said magnetic means and for carrying at least one alignment bushing through which said at least one rod is slideably mounted, and means for returning said voice coil assembly to a predetermined position along the length of said air gap in the absence of applied electrical currents, wherein said magnetic means comprises two concentrically disposed cylindrically shaped permanent magnets whose adjacent faces are oppositely poled, and said support means comprises a plurality of rods each of which are slideably mounted through respective alignment bushings which are symetrically disposed outside of the circumference of the outer one of said permanent magnets.

7. A speaker for transforming applied electrical currents into acoustical energy comprising a voice coil assembly having a coil adapted for conducting said applied electrical currents, a diaphragm coupled to said voice coil assembly, permanent magnetic means for providing a magnetic field in an air gap, support means for centering said voice coil assembly in said air gap and for allowing for the axial movement of said voice coil assembly and said diaphragm in response to the magnetic interaction between the magnetic fields produced by said voice coil and said permanent magnetic means, wherein the improvement comprises:

said permanent magnetic means comprising two concentrically disposed permanent magnets for providing a magnetic field in the air gap therebetween, and wherein the adjacent faces of said two magnets are oppositely poled, and alignment means for maintaining the linear, axial movement of said voice coil assembly, wherein said alignment means is disposed outside said voice coil assembly.

8. A speaker for transforming applied electrical currents into acoustical energy comprising a voice coil assembly having a coil adapted for conducting said applied electrical currents, a diaphragm coupled to said voice coil assembly, permanent magnetic means for providing a magnetic field in an air gap, support means for centering said voice coil assembly in said air gap and for allowing for the axial movement of said voice coil assembly and said diaphragm in response to the magnetic interaction between the magnetic fields produced by said voice coil and said permanent magnetic means, wherein the improvement comprises:

said permanent magnetic means comprising two concentrically disposed permanent magnets for providing a magnetic field in the air gap therebetween, and wherein the adjacent faces of said two magnets are oppositely poled, and alignment means for maintaining the linear, axial movement of said voice coil assembly, further including return means to return the voice coil assembly to a steady state position, wherein said return means includes means to adjust the steady state position with respect to the permanent magnets.

9. A speaker for transforming applied electrical currents into acoustical energy comprising a voice coil assembly having a coil adapted for conducting said applied electrical currents, a diaphragm coupled to said voice coil assembly, permanent magnetic means for providing a magnetic field in an air gap, support means for centering said voice coil assembly in said air gap and for allowing for the axial movement of said voice coil assembly and said diaphragm in response to the magnetic interaction between the magnetic fields produced by said voice coil and said permanent magnetic means, wherein the improvement comprises:

said permanent magnetic means comprising two concentrically disposed permanent magnets for providing a magnetic field in the air gap therebetween, and wherein the adjacent faces and said two magnets are oppositely poled, and alignment means for maintaining the linear, axial movement of said voice coil assembly, further including return means to return the voice coil assembly to a steady state position, wherein said return means includes variable bass resonance control means.

* * * * *